US005943803A

United States Patent [19]

Zinbarg

[11] Patent Number: 5,943,803

[45] Date of Patent: Aug. 31, 1999

[54] GARAGE DOOR DECORATIVE COVER

[75] Inventor: Benson Zinbarg, Stamford, Conn.

[73] Assignee: Sun Hill Industries, Inc., Stamford, Conn.

[21] Appl. No.: 09/062,932

[22] Filed: Apr. 20, 1998

[51] Int. Cl.[6] ..... G09F 7/02; E05D 15/06; E06B 3/12

[52] U.S. Cl. ..... 40/611; 160/201; 160/236

[58] Field of Search ..... 40/594, 611, 299.01, 40/638; 160/236, 201

[56] References Cited

U.S. PATENT DOCUMENTS

| | | | |
|---|---|---|---|
| 950,746 | 3/1910 | Chamberlin . | |
| 3,310,899 | 3/1967 | Hart et al. | 40/125 |
| 3,987,567 | 10/1976 | Fritts | 40/611 X |
| 4,035,940 | 7/1977 | Mickey et al. | 40/611 X |
| 4,335,774 | 6/1982 | Price | 160/84 R |
| 4,815,562 | 3/1989 | Denny et al. | 182/138 |
| 4,884,352 | 12/1989 | Lipscomb | 40/611 |
| 5,263,529 | 11/1993 | Landis | 160/236 |
| 5,307,581 | 5/1994 | Kalmykow | 40/611 |
| 5,417,273 | 5/1995 | Bamonte | 160/368.1 |
| 5,555,659 | 9/1996 | Hade | 40/604 |
| 5,598,667 | 2/1997 | Dykes | 160/236 X |
| 5,608,992 | 3/1997 | Floyd | 52/3 |
| 5,611,382 | 3/1997 | Sferra | 160/113 |
| 5,647,157 | 7/1997 | Kasahara | 40/79.2 |
| 5,649,390 | 7/1997 | Davidson | 52/3 |
| 5,685,054 | 11/1997 | Yasnogorodskiy | 29/446 |
| 5,776,588 | 7/1998 | Wotton | 428/16 |

*Primary Examiner*—Terry Lee Melius
*Assistant Examiner*—James Hewitt
*Attorney, Agent, or Firm*—David P. Gordon; David S. Jacobson; Thomas A. Gallagher

[57] ABSTRACT

A garage door cover assembly for use on an exterior surface of a garage door of the type having a plurality of door panels permitted to rotate relative to each other when the garage door moves from a closed position to an open position is provided. The garage door cover assembly includes a plurality of horizontal cover panels and, for each cover panel, fixing members to couple the panel to a garage door panel. The cover panels are provided with fanciful holiday, seasonal, or other celebratory indicia. The indicia on the panels together form a composite illustration. According to a preferred embodiment of the invention, the cover panels are made from a flexible, waterproof polyethylene.

12 Claims, 2 Drawing Sheets

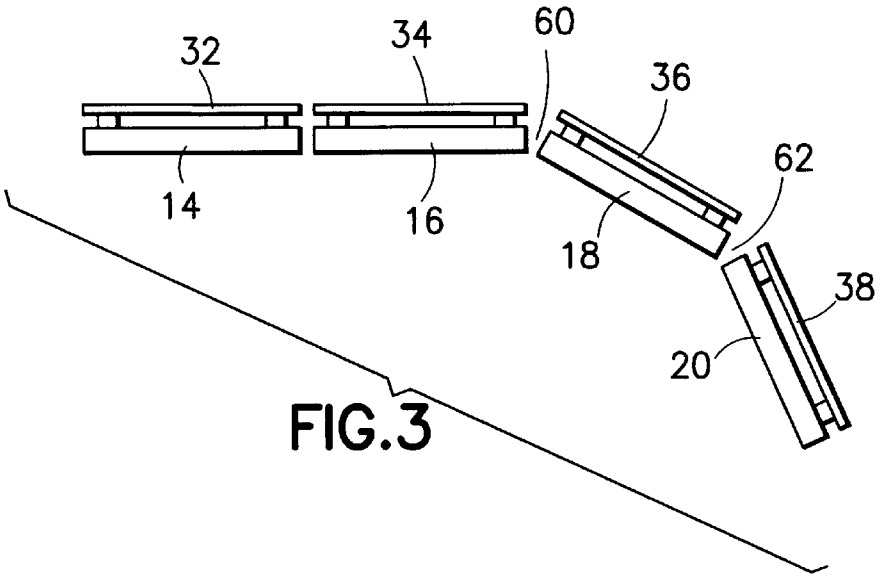
FIG.3
FIG.2
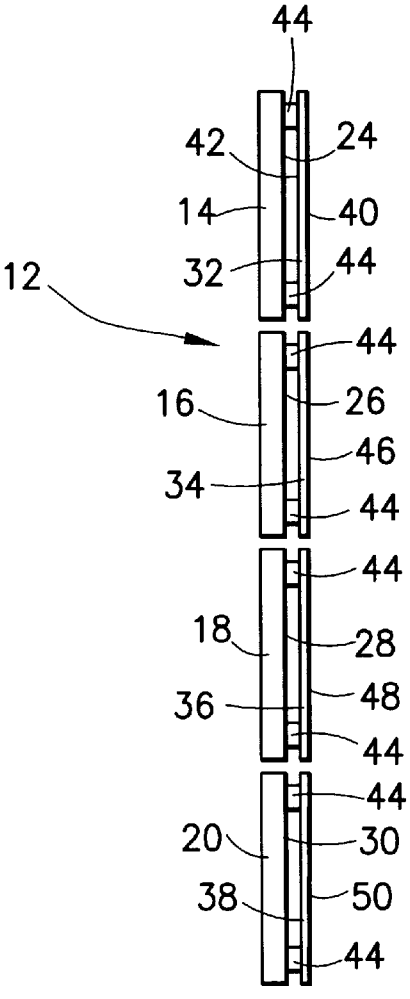

GARAGE DOOR DECORATIVE COVER

BACKGROUND OF THE INVENTION

1. Field of the Invention

This invention relates broadly to decorative panels affixable to a garage door. More particularly, this invention relates to decorative panels having seasonal, holiday, festive, or celebratory indicia and being easily removably affixed to a movable multi-panel garage door to provide an exterior decoration.

2. State of the Art

During certain times of the year, holiday, seasonal, and festive decorative objects are very popular. In the fall, around the time of the Halloween celebration, it is common to decorate one's home with decorative objects having a ghoulish theme, e.g., jack o'lanterns, ghosts, witches, and monsters. Following the Halloween celebration, and in the winter months, the image of Santa Claus and other Christmas themed images are everpresent in holiday displays. During the spring, with the approach of the Easter holiday, images of Easter bunnies are often included in decorative displays. In addition, when celebrating a birthday, an anniversary, or a graduation with a home-based party, it is common to decorate the home with a celebratory display.

In homes having a garage, one of the largest flat surfaces on the front of the home is the garage door surface. Therefore, the garage door surface is apparently well-suited to holding a large decorative display such as a large decorated flexible panel; that is, unless the display hinders the operation of the garage door. Operation of the garage door is important because seasonal and holiday decorations may be displayed for a relatively long period of time, such as a month.

However, permitting a garage door to be opened and closed while covered with a decorative panel is not easy. It will be appreciated that a majority of garage doors are made of hinged door panels having lateral wheels which ride in a track. Due to rotation at the hinges, when a garage door is in a partially open or open position gaps are created between the panels at the hinges and the vertical length across the exterior of all of the panels of the garage door (i.e., from the topmost door panel to the bottommost door panel) is relatively longer than when the door is in a closed position and the gaps are eliminated. Therefore, any decorative panel for a garage door must be able to remain on the exterior surface of the garage door which, in effect, changes in length as it is opened and closed.

A decorative panel having sufficient extra material such that the garage door is permitted to move from an open position to a closed position will buckle when closed, and the extra material may become caught in the closing gaps as the door closes, potentially causing the panel to tear. Moreover, a loose display will have an undesirable messy appearance. On the other hand, a tightly held decorative panel which does not permit movement of the panel relative to the exterior surface of the garage door will either prevent the garage door from fully opening, or will cause inadvertent removal of the panel from the garage door or tearing of the panel as the garage door is opened. Either scenario is undesirable.

U.S. Pat. No. 5,649,390 to Davidson describes a single panel flexible garage door cover which permits the garage door to which it is attached to open and close. The panel is draped over the front of a garage door and has upper and lower ends which extend around the upper and lower edges, respectively, of the garage door to the back of the garage door. The upper and lower ends of the panel are tethered together with elastic cords. As a result, when the garage door is opened, the elasticity of the cords permits movement of the panel relative to the garage door to allow the door to open. However, the door cover has several drawbacks. First, use of the cover requires a complicated webbing of elastic cords through eyelets in the cover and around axles of the garage door wheels, a time consuming process. Second, the elastic cords place the cover, especially at the eyelets, under constant tension (whether in open or closed positions) and require the garage door cover to be made from a relatively thick flexible material. Third, when the door is an open position, the web of elastic cords extends between the upper and lower ends of the cover and thereby extends into the head room of the garage. Fourth, the size of the single panel which comprises the garage door cover renders the cover relatively unsuitable for printing.

SUMMARY OF THE INVENTION

It is therefore an object of the invention to provide a decorative garage door cover which when attached to the surface of a garage door permits the garage door to open and close without the cover becoming detached.

It is another object of the invention to provide a decorative garage door cover which is held taut and has a clean appearance on the garage door.

It is a further object of the invention to provide a decorative garage door cover which is easy to attach to a garage door.

It is an additional object of the invention to provide a decorative garage door cover which is easily removable from a garage door.

It is also an object of the invention to provide a decorative garage door cover which, upon removal, will not mar a garage door to which it is attached.

A further object of the invention is to provide a decorative garage door cover which does not deplete head room in a garage when a garage door to which it is attached is in an open position.

Another object of the invention is to provide a decorative garage door cover which is inexpensive to manufacture and can be made of light-weight materials.

An additional object of the invention is to provide a decorative garage door cover which can be printed upon by conventional printing techniques.

It is still a further object of the invention to provide a decorative garage door cover which is waterproof.

In accord with these objects, which will be discussed in detail below, a garage door cover assembly for use on an exterior surface of a garage door is provided. The type of garage door for which the garage door cover assembly is designed typically has a plurality of door panels permitted to rotate (pivot) in a sequential fashion relative to each other when the garage door moves from a closed position to an open position. The garage door cover assembly includes a plurality of horizontal cover panels, each approximately the size of door panel of the garage, and, for each cover panel, fixing means to couple the panel to a garage door panel. The cover panels are provided with fanciful holiday, seasonal, or other celebratory indicia. Preferably the indicia on the panels together form a composite illustration. According to a preferred embodiment of the invention, the cover panels are flexible and waterproof.

Additional objects and advantages of the invention will become apparent to those skilled in the art upon reference to the detailed description taken in conjunction with the provided figures.

BRIEF DESCRIPTION OF THE DRAWINGS

FIG. 2 is a side view of the garage door decorative cover assembly of the invention attached to a garage door which is in a closed position; and FIG. 3 is a side view of the garage door decorative cover of the invention attached to a garage door which is in an open position.

DETAILED DESCRIPTION OF THE PREFERRED EMBODIMENTS

Figure 1:
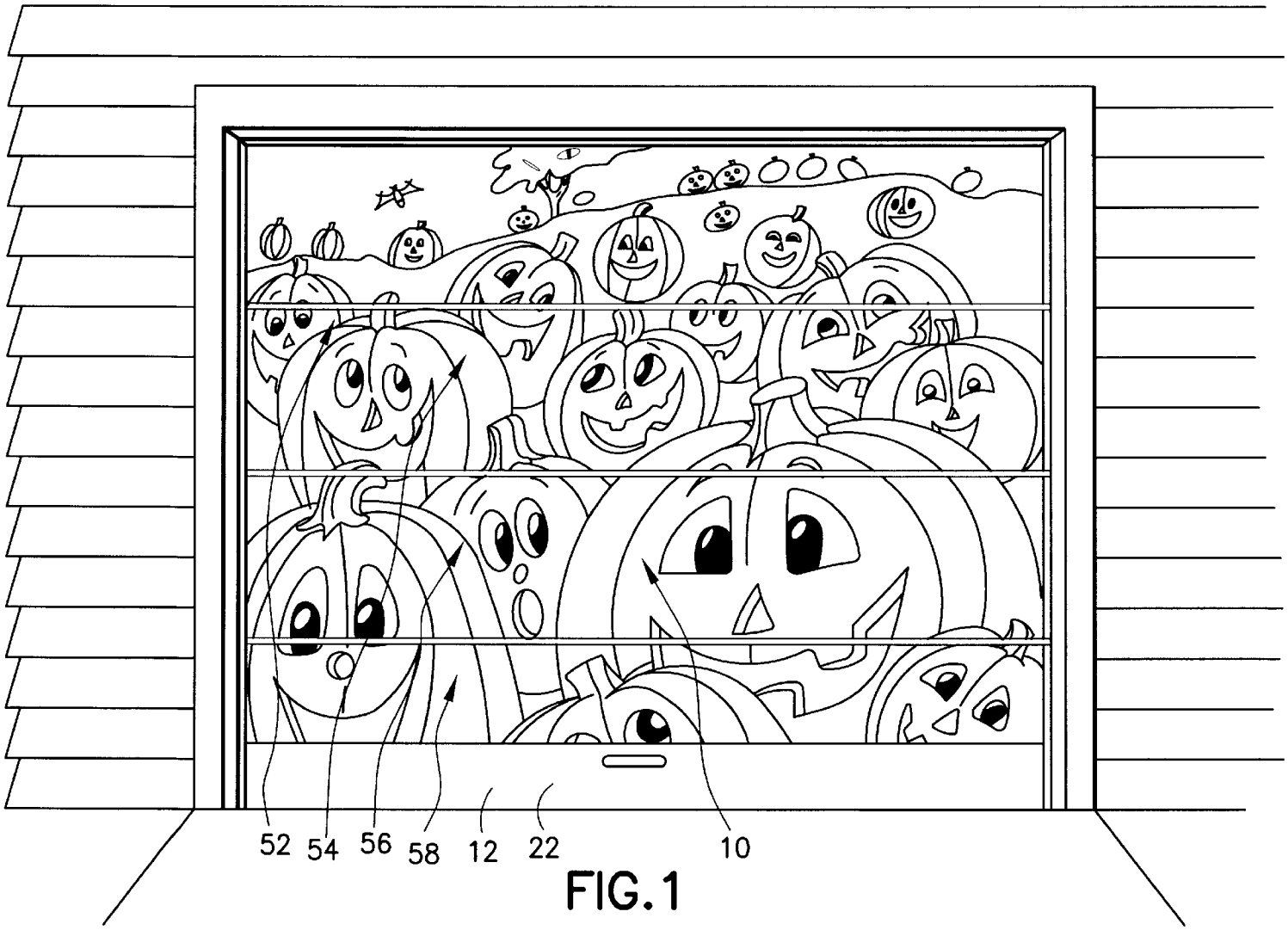
FIG. 1 is a perspective view of the garage door cover assembly of the invention attached to a garage door which is in a closed position.

Turning now to FIGS. 1 and 2, a garage door decorative cover assembly 10 is shown attached to a garage door 12. It will be appreciated that garage doors are generally made from a plurality of door panels, e.g., four door panels 14, 16, 18, 20, which are permitted to rotate (pivot) in a sequential fashion relative to each other when the garage door 12 moves from a closed position (FIG. 2) to an open position (FIG. 3). The garage door 12 has an exterior surface 22 defined by the all outer surfaces 24, 26, 28, 30 of the garage door panels 14, 16, 18, 20, respectively.

The garage door decorative cover assembly 10 is comprised of a plurality of cover panels, e.g., four cover panels 32, 34, 36, 38, one for each door panel of the garage door 12 on which the cover assembly 10 is to be attached. With respect to one cover panel 32, each cover panel has a front surface 40 and a rear surface 42 and is preferably flexible and made from 1–2 mil sheets of waterproof plastic such as polyethylene. The cover panels 32, 34, 36, 38 are attached to the garage door panels 14, 16, 18, 20 using fixing means 44, which will now be described.

Referring to FIG. 2, fixing means 44 are provided for coupling each cover panel 32, 34, 36, 38 to the outer surface 24, 26, 28, 30 of respective garage door panels 14, 16, 18, 20. Each fixing means 44 (and a plurality of spaced-apart fixing means may be used) is preferably a piece of removable, non-marring, double-sided foam tape, such as Magic Removable Mounts™ sold by Miller Studios of New Philadelphia, Ohio, although other adhesives may be used. With respect to each fixing means 44, fixing means are positioned to the outer surface 24 of a first garage door panel 32 at the lateral sides of the garage door panel. The rear surface 42 of the first cover panel 32 is then positioned to the other side of the fixing means 44 to tautly couple the cover panel 32 to the first of the garage door panels 14. The process is repeated for the remaining garage door cover panels 34, 36, 38 in order to affix the cover panels to the garage door 12 in a top-to-bottom arrangement. The front surface 40, 46, 48, 50 of each panel is provided with indicia 52, 54, 56, 58. Preferably, the indicia 52, 54, 56, 58 on the cover panels 32, 34, 36, 38 is such that a composite illustration, for example, a pumpkin patch, is formed by the top-to-bottom display of the cover panels on the garage door.

As the garage door 12 is moved from an open position to a closed position, the cover panels 32, 34, 36, 38 remain in position are not affected by (caught in) the gaps 60, 62 temporarily created between the door panels 14, 16, 18, 20 (FIG. 3). An easy-to-assemble and inexpensive-to-manufacture garage door decorative cover assembly is thereby provided.

According to a preferred embodiment of the invention, four flexible 1–2 mil polyethylene panels, each approximately 90 inches in width by 16 inches in height, are provided with sixteen fixing means (four per cover panel). The panels together depict a seasonal, holiday, or celebratory theme. In addition, the panels cover may be cut with a standard scissors to customize the size of the panels to a particular garage door.

There have been described and illustrated herein a garage door decorative cover. While a particular preferred embodiment of the invention has been described, it is not intended that the invention be limited thereto, as it is intended that the invention be as broad in scope as the art will allow and that the specification be read likewise. Thus, while the decorative cover is shown as comprising four flexible panels for a garage door having four door panels, it will be appreciated that the decorative cover may be made from more or less than four panels, as garage doors may be made with fewer or more door panels. Furthermore while particular types of materials have been disclosed, it will be understood that other materials can be used as well. For example, and not by way of limitation, while polyethylene plastic is disclosed as a preferred material for the cover panels, other flexible materials such as polypropylene, polyvinylchloride, paper, and fabric can be used. Moreover, substantially inflexible materials may also be used, such as cardboard, rigid plastic, or metal. Also, while it is preferable to use two pieces of adhesive at each end of each cover panel, it will be appreciated that one or more pieces of adhesive may be used at one end or across the top of each cover panel, and that, likewise, one or more pieces of adhesive may be used at the other end or across the bottom of each panel. In addition, while a non-marring adhesive is preferred for attaching the holding member and the panels to the exterior surface of the garage door, it will be appreciated that other fixing means may be used as well, e.g., staples, tacks, large-headed nails, other non-marring and removable adhesives in tape, foam mount, or other form, and, while not preferred, even marring or non-removable adhesives. It will therefore be appreciated by those skilled in the art that yet other modifications could be made to the provided invention without deviating from its spirit and scope as so claimed.

What is claimed is:

1. A garage door cover assembly, comprising:

a) a garage door including a plurality of door panels which are permitted to pivot in a sequential fashion relative to each other when said garage door moves from a closed position to an open position, each of said garage door panels having an exterior surface, said garage door having a garage door surface defined by said exterior surfaces of said door panels;

b) at least two cover panels, one for each of at least two of said door panels of said garage door which are adjacent, each cover panel having a front surface and a rear surface, said front surface being provided with indicia; and c) a plurality of fixing means for attaching said rear surface of each of said cover panels to said exterior surface of a respective said door panel of said garage door, wherein when said cover panels are attached with said fixing means to said at least two adjacent door panels of said garage door, said indicia on said front surfaces of said at least two cover panels form a composite illustration.

2. A garage door cover assembly according to claim 1, wherein:

said fixing means removably fixedly attaches said rear surface of said at least two cover panels to the garage door surface.

3. A garage door cover assembly according to claim 2, wherein:

said fixing means is non-marring to the garage door surface when said fixing means is removed from the garage door surface.

4. A garage door cover assembly according to claim 1, wherein:

said composite illustration is of a fanciful holiday theme, fanciful seasonal theme, or fanciful celebratory theme.

5. A garage door cover assembly according to claim 1, wherein:

said at least two cover panels are flexible.

6. A garage door cover assembly according to claim 1, wherein:

said at least two cover panels are waterproof.

7. A garage door cover assembly according to claim 1, wherein:

said at least two cover panels are made from polyethylene.

8. A garage door cover assembly according to claim 1, wherein:

said composite illustration is of a fanciful holiday theme, fanciful seasonal theme, or fanciful celebratory theme, and said at least two cover panels are flexible and waterproof.

9. A garage door cover assembly according to claim 8, wherein:

said fixing means removably fixedly attaches said rear surface of said at least two cover panels to the garage door surface, and said fixing means is non-marring to the garage door surface when said fixing means is removed from the garage door surface.

10. A garage door cover assembly according to claim 1, wherein:

said at least two cover panels is four cover panels for four garage door panels.

11. A garage door cover assembly according to claim 10, wherein:

said composite illustration is of a fanciful holiday theme, fanciful seasonal theme, or fanciful celebratory theme, and said four cover panels are flexible and waterproof.

12. A garage door cover assembly according to claim 11, wherein:

said fixing means removably fixedly attaches said rear surface of said four cover panels to the garage door surface, and said fixing means is non-marring to the garage door surface when said fixing means is removed from the garage door surface.

* * * * *